United States Patent [19]

Langen et al.

[11] 4,003,748

[45] Jan. 18, 1977

[54] INCORPORATION PROCESS

[75] Inventors: Hans Langen, Bonn; Erwin Ranz, Leverkusen; Rudolf Meyer, Leverkusen; Johannes Sobel, Leverkusen, all of Germany

[73] Assignee: AGFA-Gevaert, A.G., Leverkusen, Germany

[22] Filed: Mar. 3, 1975

[21] Appl. No.: 554,716

[30] Foreign Application Priority Data

Mar. 7, 1974 Germany ..... 2410914

[52] U.S. Cl. ..... 96/84 UV; 96/22; 96/56; 96/84 R; 96/95; 96/100; 96/120

[51] Int. Cl.[2] ..... G03C 1/84; G03C 1/40

[58] Field of Search ..... 96/100, 84 UV, 56

[56] References Cited

UNITED STATES PATENTS

| | | | |
|---|---|---|---|
| 2,353,262 | 7/1944 | Peterson et al. | 96/100 |
| 3,689,271 | 9/1972 | Nittel et al. | 96/100 |
| 3,764,336 | 10/1973 | Nittel et al. | 96/100 |
| 3,779,765 | 12/1973 | McCrossen et al. | 96/100 |
| 3,860,425 | 1/1975 | Ono et al. | 96/100 |

*Primary Examiner*—J. Travis Brown
*Attorney, Agent, or Firm*—Connolly and Hutz

[57] ABSTRACT

A photographic silver halide material with at least one halide emulsion layer and at least one substance in heterogeneous contribution emulsified in oilformer compounds and a process of preparing the said photographic silver halide materials. The substances are introduced into photographic emulsions prior to coating by way of adding a hydrophilic phase containing in emulsified form the substances which are emulsified in the hydrophilic phase in form of a solution containing at least one substantially diffusion-resistant, substantially water-insoluble, substantially non-coupling dispersible β-diketo compound with at least 9 carbon atoms, β-keto carboxylic acid ester, β-keto carboxylic acid amide, cyanoacetyl compound or β-dicarboxylic acid ester with at least 13 carbon atoms as oilformer. The photographic material shows advantageous results i.a. with respect of stability of the emulsified substances in the layers and excellent sensitometric results.

8 Claims, No Drawings

INCORPORATION PROCESS

This invention relates to a process for introducing substances into photographic emulsions suitable for forming photographic light-sensitive and light-insensitive layers, more especially for introducing couplers into photographic silver halide emulsions, and to a light-sensitive photographic material with improved properties.

It is known that emulsifiable compounds such as, for example, couplers, UV-absorbers, white toners and similar additives, can be introduced by means of so-called oil formers either into gelatin solutions or directly into water, optionally in the presence of aditionally wetting agents. According to U.S. Pat. Nos. 2,322,027 and 2,533,514 for example, colour couplers are incorporated into water-soluble photographic colloids by dissolving the colour coupler in a water-insoluble organic solvent of relatively high boiling point, and emulsifying or dispersing the solution in the photographic emulsion.

The disadvantage of this process is that hydrophilic developers in particular, for example of the N-butyl-N-δ-sulphobutyl-p-phenylene diamine type, show little or no penetration into the droplets of oil. This results in a loss of sensitivity, in flattening of gradation and in reduced image density. On the other hand, residues of hydrophobic developers can be retained in the droplets and can give rise to fogging when the photographic material is treated in oxidising bleach baths.

Hydrophilic substances, such as for example colour couplers which may form an enolate form or which contain a sulpho or carboxyl group, are introduced into the gelatin of the form of their sodium salts. Since the gelatin solutions are subsequently adjusted to a pH-value in the range of from 6,2 to 6.5, these hydrophilic compounds in certain cases precipitate or recrystallise. This precipitation or recrystallising effect uncontrollably influences senitivity, gradation and colour density.

The use of lithium salts and larger additions of wetting agents did not produce any significant improvements either. In addition, numerous hydrophilic substances from the aforementioned group have the property of increasing the viscosity of the casting solution, in some cases to such a considerable extent that solutions of this kind can no longer be processed.

In another process, emulsifiable compounds are dissolved in a volatile solvent substantially immiscible with water, such as ethyl acetate, diethyl carbonate, methylene chloride or chloroform, the resulting solution dispersed in the form of extremely fine droplets in the presence of a wetting agent or dispersant in an aqueous, non-lightsensitive, hydrophilic, colloidal medium, especially in aqueous gelatin, the solvent evaporated off or after solidification noodled and subsequently rinsed out with water, and the non-lightsensitive hydrophilic colloid composition containing the dispersed compounds is mixed with the corresponding casting solution, for example a silver halide emulsion.

Unfortunately, this process also involves difficulties. Removal of the solvent from the non-lightsensitive hydrophilic colloid composition can involve difficulties, and if a little of the solvent is left behind in the gelatin, its presence can promote a tendency towards agglomeration among the dispersed, fine droplets. This is particularly undesirable in emulsion layers containing colour couplers in dispersed form, because agglomeration of the droplets results in coarsening of the colour grain.

Another problem which has not yet been satisfactorily solved in practice is that the substances incorporated into lightsensitive materials, especially colour couplers and the dyes formed from them, have to be sufficiently stable under the effect of light, elevated temperature and moisture, even in the event of prolonged storage times of processed or even exposed or unexposed, unprocessed photographic materials. They also have to be adequately resistant to gaseous or dissolved reducing or oxidising agents.

Damaging agents which are capable of seriously affecting the stability of the colour couplers or of the dyes formed and of the silver halide emulsion layer, cannot always be completely avoided in practice during the production and storage of photographic materials. Neither is it altogether clear in a number of cases what influences have affected the stability of a colour coupler, the dye formed or the silver halide emulsion.

As described in "Defensive Publication No. T 900,028", the presence of traces of aldehydes in unprocessed photographic materials gives rise to considerable colour fogging and to a reduction in colour yield. The influence of aldehydes cannot in practice always be ruled out, because plastic materials frequently contain aldehydes which undesirably pollute the surrounding atmosphere with aldehyde gases.

In addition, the photographic materials may be hardened by formaldehyde or aldehyde-containing or aldehyde-liberating hardening agents, in order to guarantee faster processing at elevated temperatures. In some cases, the photographic substrate, for example a baryta paper, is hardened with aldehyde hardeners, as described in U.S. Pat. No. 2,895,8827.

Attempts have already been made to improve the stability of lightsensitive materials by adding stabilisers or aldehyde binding agents to the photographic materials. In this connection, reference is made for example to German Offenlegungsschrifts Nos. 1,772,816 and 2,227,144, to U.S. Pat. No. 2,895,827 and to Defensive Publication No. T 900,028 in which aldehyde-binding agents are proposed.

However, the compounds disclosed have the disadvantage that they cannot be introduced into the layer in sufficiently diffusion-resistant form, with the result that they have to be used in large concentrations. In addition, they are generally washed out of the layer during photographic processing, so that they are no longer able adequately to improve the stability of the finished photographic material. The compounds proposed in the "Defensive Publication" cannot be used in practice because they cannot be used in the silver halide emulsion layer and, hence, are unable adequately to protect the stability of the silver halide, the latent image nuclei or the colour couplers or dyes.

Known stabilisers which can be incorporated into the silver halide emulsion layer and which are able to stabilise the silver halide and the latent image nuclei formed, generally cannot be used for protecting the photographic material against the damaging effect of formaldehyde. Compounds which react with the formaldehyde, such as mercaptans or uracil, generally result in a considerable reduction in sensitivity so that they cannot be incorporated into the silver halide emulsion.

It can be noticed that photographic materials containing such additives as, for example, couplers added with oil formers in dispersed form, are more stable under the effect of the damaging influences referred to above than similar materials into which couplers for example have been introduced in soluble form, so that it may be assumed that the hydrophobic oil droplet slows down the attack of a damaging agent. Nevertheless, the stability of the aforementioned additives, where they have been introduced into the photographic material by means of oil formers, is also unsatisfactory in practice, especially in cases where the photographic materials have been stored under humid conditions, for example at 60° C/98% humidity, before or after exposure.

Accordingly, there is in practice a need to develop a process for incorporating photographic additives which is not attended by any of the disadvantages referred to above.

It now has been found a process for the production of photographic layers containing emulsified substances in heterogeneous distribution, the substances being emulsified in known manner into the hydrophilic phase in the form of a solution which hydrophilic phase may be used directly as casting solution for the photographic layer. Alternatively the hydrophilic phase, which can be a gelatine solution or a water solution, is mixed with a hydrophilic colloidal solution or a photographic silver halide emulsion and the emulsion formed being applied to a substrate. The process according to the invention is characterised by the fact that the substances are introduced into the hydrophilic phase in the presence of substantially diffusion-resistant, substantially water-insoluble, substantially non-coupling dispersible aliphatic open-chained or ringclosed β-diketo compounds containing at least 9 carbon atoms, β-keto carboxylic acid esters with preferably at least 7 carbon atoms, β-keto carboxylic acid amides, cyanoacetyl compounds or β-dicarboxylic acid esters with at least 13 carbon atoms as oil formers.

The invention also relates to a lightsensitive material which comprises at least one silver halide emulsion layer and which contains emulsified substances in at least one hydrophilic colloid layer, consisting of a solution of those substances in a substantially water-insoluble, substantially non-coupling diffusion-resistant aliphatic open-chained or ringclosed β-diketo compound containing at least 9 carbon atoms, β-keto carboxylic acid esters with preferably at least 7 carbon atoms, β-keto carboxylic acid amides, cyano acetyl compounds or β-dicarboxylic acid esters with at least 13 carbon atoms which have been dispersed in the hydrophilic colloid layer.

The photographic materials according to the invention are surprisingly distinguished from conventional materials of the kind obtained in accordance with German Offenlegungsschrift No. 2,042,659 or U.S. Pat. Nos. 2,322,027 and 2,533,514 by the following facts:

a. Colour couplers incorporated by emulsification are highly reactive in cases where hydrophilic and also hydrophobic developer substances are used;
b. Bleaching of the residual silver takes place smoothly without any problems;
c. The photographic materials are surprisingly highly stable, even when stored under humid conditions at 60° C/98% relative humidity; and
c. Coarsening of the colour grain, colour fogging and reduction of the colour density are largely avoided.

Although the oil formers according to the invention themselves represent an active keto methylene compound of the kind commonly used in coupler chemistry, it is nevertheless surprising that the compounds do not interfere to any appreciable extent with the chromogenic devlopment of the colour couplers used in conventional colour photographic materials, provided that by suitably selecting the substituents, steps are taken to ensure that the coupling rate of the colour couplers incorporated in the layer by emulsification is higher than that of the oil formers added according to the invention.

By suitably selecting the substituents on the active methylene group of the oil formers according to the invention, it is possible in accordance with the invention to use both high-boiling and also low-boiling solvents for photographic substances.

Compounds corresponding to the following general formula are particularly suitable for use as oil formers in accordance with the invention;

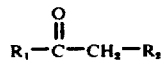

in which $R_2$ represents a cyano group or the group $COR_3$;

$R_1$ and $R_3$ which may be the same or different represent preferably a linear or branched chain, saturated or olefinically unsaturated alkyl group with preferably up to 20 carbon atoms, a cycloalkyl group such as cyclohexyl or cyclopentyl, an aryl group such as phenyl or naphthyl, an aralkyl group such as benzyl or phenylethyl, an alkoxy group, an aroxy group such as, for example, phenoxy or naphthoxy, an aralkoxy group such as phenylbutoxy or naphthylethoxy or additionally $R_1$ or $R_3$ may represent a secondary or tertiary amino group, in which case one or both hydrogen atoms can be substituted by the same or different radicals, preferably alkyl, aryl or aralkyl radicals; and where $R_1$ and $R_3$ represent alkyl, the number of carbon atoms in the alkyl groups is at least 6 and, where $R_1$ represents alkoxy and $R_3$ represents alkoxy or aralkoxy the number of carbon atoms in the radicals $R_1$ and $R_3$ is at least 10; or $R_1$ and $R_3$ may together represent the atoms required to complete an aliphatic or heterocyclic, preferably 5- or 6-membered ring which is substituted by alkyl or aryl or contains an anellated heterocyclic, heteroaromatic or aromatic ring, the total number of carbon atoms in the radicals $R_1$ and $R_3$ amounting to at least 6.

Accordingly, particularly suitable compounds of the above formula are derived from substantially diffusion-resistant aroyl acetic esters, alkoyl acetic esters, cyano acetic acid esters, malonic acid derivatives and also from cyclic dicarbonyl compounds. Where $R_1$ and/or $R_3$ represent alkyl, the aforementioned alkyl radicals may be saturated or unsaturated and may be interrupted by one or more ether oxygen bridges. The total number of carbon atoms in the above formula is preferably no more than 40, more especially no more than 20. If desired, the groups mentioned in the definition of $R_1$ and $R_3$ may be further substituted by, for example, alkyl, aryl, alkoxy, aroxy, halogen, hydroxy, esterified carboxy or by a secondary or tertiary amino group; these substituents may be in any position provided that steps are taken to ensure that the molecule formed is substantially free of yellow coupler properties, Accordingly, the oil formers which may be used in accordance with the invention are derived from compounds that are readily available in practice. Compounds which are particularly suitable for use in practice contain short-chain or, preferably, branched alkyl groups with no more than 20 carbon atoms, aryl alkoxy-alkyl or aryl radicals which preferably contain several short-chain, preferably branched alkyl radicals or cycloalkyl radicals. If desired, longer-chain alkyl radicals may be interrupted by one or more ether-oxygen bridges and may contain further ester, hydroxyl or secondary amino groups.

The oil formers according to the invention do not contain any acid groups in the accepted sense, such as sulpho groups or carboxylic acid groups, and are therefore highly compatible with hydrophilic colloids, for example a gelatin solution, and do not have any adverse effect upon the viscosity properties of the emulsion.

The particular advantage of the oilformers according to the invention is that, at the same time, they effectively dissolve photographic additives, for example colour couplers, and form highly stable dispersions in a gelatin solution. In addition, because of their active methylene group, they afford protection against the effect of damaging agents which would otherwise react with the colour couplers. On the other hand, the attack of oxidised colour developers on the coupler is not impaired so that, surprisingly, the colour density of the images obtained is outstanding and, even where unprocessed materials are stored under humid conditions, the loss of colour density by comparison with freshly processed materials is considerably less than it is in conventional materials containing, for example, dibutylphthalate or tricresyl phosphate as oil formers.

The literature describes numerous coupler solvents of which triaryl esters of phosphoric acids and dialkyl esters of phthalic acids, of the kind described for example in U.S. Pat. No. 3,703,375, have acquired particular significance in photography. The oilformers according to the invention are superior to the compounds disclosed in that Patent, because the stability of the couplers under the effect of humid air is improved, which is of crucial significance in the case of pyrazolone couplers in particular. In addition, it is possible by virtue of the process according to the invention to obtain coloured images of a outstanding sharpness.

Examples of suitable compounds are shown below:

1)

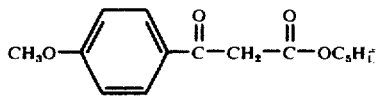

2)

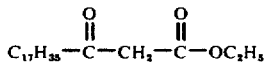

3)

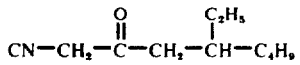

4)

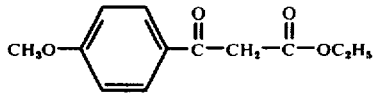

-continued

5)

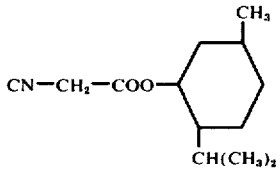

6)

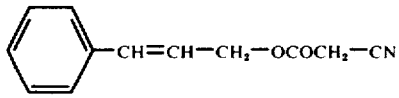

7) $C_9H_{19}COCH_2COCH_3$

8) $C_{11}H_{23}-COCH_2COCH_3$

9) $C_{13}H_{27}COCH_2-COCH_3$

10) $C_{17}H_{33}-COCH_2COCH_3$

11) $C_8H_{17}-COCH_2COOC_2H_5$

12) $C_{11}H_{23}COCH_2COOC_2H_5$

13) $C_{13}H_{27}COCH_2COOC_2H_5$

14) $C_{15}H_{31}COCH_2COOC_2H_5$

15)

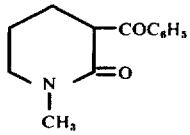

The preparation of the oilformers used in accordance with the invention is known and is described in relevant text books.

For example compounds 7 to 10 can be prepared according to the methods described in U.S. Pat. Nos. 2,158,071, 2,218,026, 2,313,621 and Organic Synthesis Coll. vol. III, 292 (1955). Compounds 11 -14 can be prepared according to the methods described in B 72, 37 (1939) and J.pharm.Soc. Japan 61, 83 (1941).

Compound 5 is obtainable according to the method described in Liebigs Ann.Chem. 420, 60, compound 6 according to the method described in J. Amer. Chem. Soc. 66, 1613 (1944). Compounds 1 to 4 are obtainable by known preparation methods of coupler chemistry. Compound 15 can be abtained according to the method described in B 95, 2438 (1962).

The process according to the invention is generally carried out as follows:

Emulsifiable substances, for example couplers such as colour couplers, masks or DIR couplers, UV-absorbers, white toners or stabilisers, are dissolved together with the compounds to be used in accordance with the invention either individually or together in a substantially water-immiscible organic solvent and optionally by means of an emulsifier, are emulsified into the casting solution for the photographic layer, which contains the binder and, optionally, other ingredients, in the ratio corresponding to the required concentration of the substance to be incorporated. Examples of emulsifiers suitable for this purpose are high-speed stirrers, so-called mixing sirens, Ultraturrax or ultrasonic mixers.

The solution of the colour coupler does not have to be directly dispersed or dissolved in the casting composition of the silver halide emulsion layer or another water-permeable layer. This solution can with advantage initially be dispersed or dissolved in an aqueous solution or an aqueous solution of a non-light sensitive hydrophilic colloid, after which the resulting mixture, optionally following removal of the organic solvent used, is thoroughly mixed with this casting composition of the lightsensitive silver halide emulsion layer or another water-permeable layer just before application. More detailed information on particularly suitable techniques for incorporating colour couplers into hydrophilic colloid layers of a photographic material can be found in published Dutch Patent Application Nos. 6,516,423; 6,516,424; 6,600,098; 6,600,099 and 6,600,628; in Belgain Patent Specification No. 750,889; in U.S. Pat. No. 2,304,940 and in British Patent Specification No. 791,219, which naturally have to be modified by the process according to the invention using the oilformers according to the invention.

Hydrophilic substances for example the colour couplers referred to earlier, which contain carboxyl groups or $-SO_3H$ groups, are incorporated in a different way. In this case, the oilforming substances to be used in accordance with the invention, preferably those containing a tertiary amino group, are dissolved in an alkaline liquid together with the additives present in alkali-soluble form and a wetting agent, and the resulting solution is added with intensive stirring to an acidified casting solution as described above. The pH-value of the casting solution changes to 6.2 – 6.5. Certain colour couplers without any $SO_3H$- or COOH-groups, which are alkali-soluble as enolates, can also be similarly incorporated.

The advantages of the oilforming substances used in accordance with the invention, in addition to their very marked crystallisation-inhibiting effect, especially on co-emulsified colour couplers, is that they do not interfere with the coupling of oxidised colour developers. The compounds form enolates in the alkaline range, i.e. during development. In contrast to known oil formers with lower carboxylic acid groups or those with only one short fatty acid radical, the compounds described here are not rinsed out with water in alkaline medium. Accordingly, they also prevent precipitation of the dye formed and the occurance of irregular dyed dye areas in areas of the image which should be dyed uniformly. The colour couplers are also prevented from crystallising out, during digestion and in the emulsion layer. In addition, the compounds used in accordance with the invention, in contrast to known hydrophobic oil formers, do not result in uniformingly flattening of gradation or in any uniform reduction of image density, In addition, they largely prevent the increase in viscosity during digestion which is caused by numerous colour couplers containing COOH- or $SO_3H$-groups.

The compounds according to the invention also have the following advantages: the tendency towards crystallisation of the substances to be emulsified is effectively suppressed, so that even readily crystallising substances can be emulsified without any recrystallisation occurring. Stability under the effect of humid air is considerably improved.

The oilforming substances described here are generally used in a ratio of 0.1 to 10 parts by weight per part by weight of the substances to be incorporated, the preferred range being from 0.3 to 1 part by weight. The higher concentrations of up to 10 parts by weight are of interest in those cases where only small quantities of an additive, for example a stabiliser, are to be introduced into the casting solution. If desired the oil formers used in accordance with the invention can of course be partly replaced by low-boiling solvents or by higher-boiling oil formers, such as dibutyl phthalates, "partly" meaning preferably no more than 50% of the required quantity of solvent.

Examples of particularly suitable, water-immiscible organic solvents are chlorinated short-chain aliphatic hydrocarbons, for example methylene chloride, ethylene chloride, also ethyl acetate, formates such as, for example, ethyl formate, or ketones such as methyl-n-propyl ketone, ethers such as diisopropyl ether, cyclohexane, toluene and diethyl carbonate.

Suitable lightsensitive emulsions are emulsions of silver halides such as silver chloride, silver bromide or mixtures thereof, which may contain up to 10 mol % of silver iodide, in one of the hydrophilic binders normally used. The binder which is preferably used for the photographic layers is gelatin, although it can be partly replaced by other film-forming, natural or synthetic polymers such as, for example, alginic acid and its derivatives such as salts, esters or amides, carboxy methyl cellulose, alkyl cellulose, starch and its derivatives, polyvinyl alcohol, copolymers with vinyl alcohol and vinyl acetate units, polyvinyl pyrrolidone, anionic polyurethanes and other latices, such as for example copolymers of acrylic esters, acrylonitrile and acryl amide.

The photographic layers may contain any known substances, such as antifog agents, stabilisers, hardening agents, plasticisers and wetting agents. In addition, they may be both chemically and spectrally sensitised.

The lightsensitive emulsions can be chemically sensitised by carrying out ripening in the presence of small quantities of sulphur-containing compounds, for example allyl isothio cyanate, allyl thio urea or sodium thio sulphate. The photosensitive emulsions may also be sensitised by the tin compounds described in Belgian Patent Specifications Nos. 493,464 and 568,687, by polyamides such as diethylene triamine, or by the amine methane sulphinic acid compounds described in Belgian Patent Specification No. 547,323, or by small quantities of noble metal compounds such as compounds of gold, platinum, palladium iridium, ruthenium and rhodium. This method of chemical sensitisation is described in the article by R. Koslowsky Z. Wiss. Phot. 46, 65–72 (1951). The emulsions can also be sensitised with polyalkylene oxide derivatives, for example polyethylene oxide with a molecular weight in the range from 1000 to 2,000, with condensation products of alkylene oxides and aliphatic alcohols, glycols, cyclic dehydration products of hexitols, with alkyl-substituted phenols, aliphatic carboxylic acids, aliphatic amines, aliphatic diamines and amides.

The condensation products have a molecular weight of at least 700, preferably more than 1000. In order to obtain special effects, these sensitisers may of course to used in combination, as described in Belgian Patent Specification No. 537,278 and British Patent Specification No. 727,982.

The emulsions containing colour couplers can also contain spectral sensitisers, for example the usual monomethine or polymethine dyes such as cyanines, hemicyanines, streptocyanines, merocyanines, oxonols, hemioxonols, styryl dyes or others, also trinuclear or polynuclear methane dyes, for example rhodacyanines or neocyanines. Sensitisers of this kind are described, for example, in F. M. Hamer's book "The Cyanine Dyes and Related Compounds" (1964) Interscience Publishers, John Wiley & Sons, New York.

The emulsions can contain the usual stabilisers, for example homopolar or salt-like compounds of mercury with aromatic or heterocyclic rings, such as mercapto triazoles, simple mercury salts, sulphonium mercury double salts and other mercury compounds. Other suitable stabilisers include azaindenes, preferably tetra- or penta-azaindenes, especially those substituted by hydroxyl or amino groups. Compounds of this kind are described in the article by Birr. Z. Wiss, Phot. 47, 2–58 (1958). Other suitable stabilisers are, inter alia, heterocyclic mercapto compounds, for example phenyl mercapto tetrazol, quaternary benzthiazole derivatives, and benztriazole.

The emulsions can be hardened in the usual way, for example with formaldehyde or halogen-substituted aldehydes containing a carboxyl group, such as mucobromic acid, diketones, methane sulphonic acid esters, and dialdehydes.

The emulsions may also be used with hardeners of the epoxy type, of the heterocyclic ethylene imine type or of the acryloyl type. Examples of hardeners of this kind are described, for example, in German Offenlegungsschrift No. 2,263,602. It is also possible to harden the emulsions by the process disclosed in German Offenlegungsschrift No. 2,218,009.

The process according to the invention can be used with advantage, for example, for incorporating filter dyes and antihalo dyes into pure gelatin for preparing filter layers or antihalo layers, preferably for incorporating colour couplers and mask-forming compounds, also for developer substances, sensitising dyes and stabilisers. The aforementioned compounds are incorporated in particular into lightsensitive silver halide gelatin emulsions of black-and-white or colour photographic materials.

In the context of the invention, a "colour coupler" is a compound which forms a dye with an oxidized colour developer in silver halide photography. A mask-forming compound is a compound which reacts with such a colour coupler in an oxidising bleach bath (cf. for example British Patent Specification No. 880,862 and 975,932), or coloured colour couplers which release an azo group under the conditions of chromogenic development. Compounds of this kind are known and are described, for example, in U.S. Pat. No. 2,584,349. A DIR-coupler or DIR-compound is a colourless coupler capable of splitting of a Development-Inhibiting Reactant by formng a dye or a colourless compound with oxidised colour developer in silver halide photography.

The colour materials according to the invention contain the oil formers in at least one photograhic emulsion layer which can be any layer of the photographic material, but is preferably an emulsion layer containing a magenta coupler. The oil formers according to the invention can of course also be present in more than one photographic emulsion layer. The photographic emulsion layer may be an auxiliary layer; protective layer; adhesion layer; a silver halide emulsion layer or an intermediate layer or filter layer. Preferred materials according to the invention contain a diffusion-resistant magenta coupler, more especially a pyrazolone-5 type magenta coupler, incorporated in accordance with the invention in the green-sensitised silver halide emulsion layer.

The material according to the invention may be, for example, positive, negative or reversal materials with the usual layer substrates which are used in known manner for the production of photographic materials. Examples of suitable substrates are films of cellulose nitrate, cellulose acetate, such as cellulose triacetate, polystyrene, polyesters, such as polyethyleneterephthalate, polyolefins such as polyethylene or polypropylene, a baryta paper or a polyolefin-coated paper, for example a polyethylene-coated paper substrate, or glass.

Suitable wetting agents which may be used in accordance with the invention for incorporating photographic additives are described by Gerhard Gewalek in "Wasch- und Netzmittel", Akademie-Verlag Berlin (1962). Examples include the sodium salt of N-methyl oleyltauride, sodium stearate, the sodium salt of heptadecenyl benzimidazole sulphonic acid, sodium salt of higher alkyl sulfonates, for example sodium salt of 2-methylhexylsulfate, sodium diisooctyl sulpho succinate, sodium dodecyl sulphonate and the sodium salt of tetradecyl benzene sulphonic acid.

Colour couplers suitable for use in accordance with the invention include any of the standard, colourless compounds which react with oxidation products of colour developer substances to form azomethine dyes or azo dyes. For example, compounds derived from phenol or from $\alpha$-naphthol are generally used as cyan couplers in particular derived of 2-aminophenol or of naphthamide compounds, compounds derived from 2-pyrazolin-5-one or from indazolone are used as magenta couplers in particular 3-acylamino or 3-anilinopyrazolone type compounds and compounds derived from $\beta$-keto carboxylic acid derivatives, for example from benzoyl acetanilide or pivaloyl acetanilides, are used as yellow couplers. It is possible to use couplers of the kind whose coupling position is not substituted, so-called 4-equivalent couplers, or couplers of the kind containing a substituent in the coupling position which is split off during the reaction with the developer oxidation products, so-called 2-equivalent couplers, or so called DIR couplers or DIR compounds which liberate a development inhibitor. Examples of standard colour couplers are described for example in the article by W. Pelz in "Mitteilungen aus den Forschungslaboratorien der Agfa Leverkusen-Munchen", Vol. 3, Page 111 and in the following patent specifications: U.S. Pat. No. 2,728,658, GB No. 1,351,395, U.S. Pat. No. 3,227,550, U.S. Pat. No. 3,265,506, Be No. 713,450, GB No. 956,261, U.S. Pat. No. 3,632,345 and U.S. Pat. No. 3,227,554.

Standard colour developers, for example standard aromatic compounds containing at least one primary amino group of the p-phenylene diamine type, are used to produce the dyes. Examples of suitable colour developers include N,N-dimethyl-p-phenylene diamine; N,N-diethyl-p-phenylene diamine; monomethyl-p-phenylene diamine; 2-amino-5-diethyl amino toluene; N-butyl-N-$\omega$-sulphobutyl-p-phenylene diamine and 2-amino-5-(N-ethyl-N-$\beta$-methane sulphonamido ethyl amino)-toluene. Other suitable colour developers are described, for example, in J. Amer. Chem. Soc. 73, 3000–3025 (1951).

EXAMPLE 1

The following emulsified products were prepared:

1. 15 g of the following cyan coupler

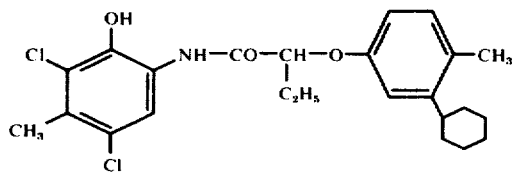

were dissolved together with 15 g of dibutyl phthalate in 45 ml of ethyl acetate, and the resulting solution emulsified at 50° C into 150 ml of a 5% gelatin solution containing 1.5 g of sodium dodecyl benzene sulphonate. After solidification, the emulsified product was converted into noodle form and freed substantially completely from the ethyl acetate by rinsing with water for 3.5 hours at 12° C. The emulsified product thus treated was added to 1.325 kg of a red-sensitised silver halide emulsion which contained per kg 0.12 mol of silver chloride, 0.03 mol of silver bromide and 100 g of gelatin.

2. A second emulsion sample was prepared in the same way as described in (1) above, except that compound No. 2 according to the invention was used instead of dibutyl phthalate.

3. 25 g of the following magenta coupler

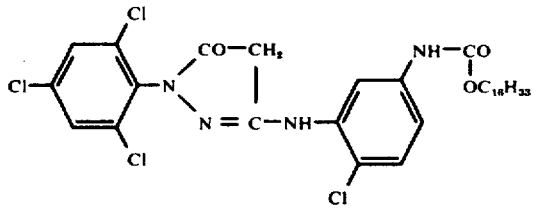

were dissolved together with 2.5 g of sulpho succinic acid-bis-(2-ethyl)-hexyl ester and 25 g of dibutyl phthalate in 100 ml of diethyl carbonate, and the resulting solution emulsified at 50° C into 250 ml of a 10% gelatin solution. Following removal of the diethyl carbonate in a thin-layer evaporator, the emulsified product was added to 1 kg of a green-sensitised silver halide emulsion containing per kg 0.15 mol of silver chloride, 0.04 mol of silver bromide and 100 g of gelatin.

4. An emulsion sample was prepared in the same way as described in (3) above, except that compound No. 3 according to the invention was used instead of dibutyl phthalate.

5. An emulsion sample was prepared in the same way as described in (3) above, except that compound No. 1 according to the invention was used instead of dibutyl phthalate.

6. 25 g of the following magenta coupler

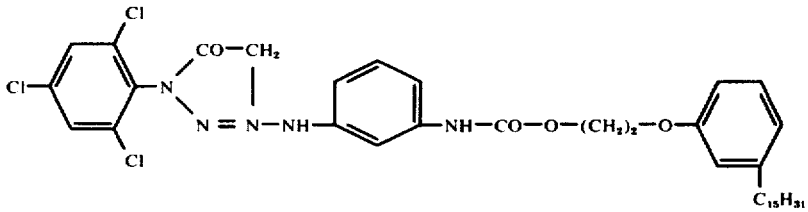

were dissolved together with 12.5 g of tricresyl phosphate and 2.5 g of sulpho succinic acid -bis-(2-ethyl)-hexyl ester in 62.5 ml of ethyl acetate, and the resulting solution emulsified at 50° C into 250 ml of a 10% gelatin solution. Following removal of the solvent in a thin-layer evaporator, the emulsified product was added to a green sensitised silver halide emulsion in the same way as described in (3) above.

7. An emulsion sample was prepared in the same way as described in (6) above, except that compound No. 1 according to the invention was used instead of tricresyl phosphate.

8. 45 g of the following yellow coupler

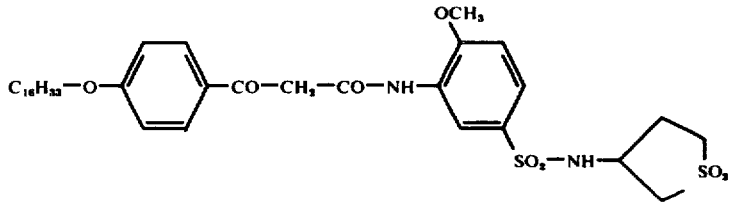

were dissolved together with 4.5 g of sodium dodecyl benzene sulphonate and 30 g of dibutyl phthalate in 100 ml of ethyl acetate, and the resulting solution emulsified at 50° C into 800 ml of a 10% gelatin solution. The mixture was added to 1 kg of an unsensitised silver halide emulsion containing per kg 0.22 mol of silver bromide and 100 g of gelatin.

9. An emulsion sample was prepared in the same way as described in (8) above, except that compound No. 4 according to the invention was used instead of dibutyl phthalate.

Colour photographic multilayer materials were prepared as described in the following with the emulsion samples thus produced:

GENERAL PROCEDURE

The following layers were successively applied to a polyethylene-coated paper substrate:

1. an adhesion layer
2. a red-sensitised silver halide emulsion layer with a cyan coupler
3. a gelatin-containing intermediate layer 4. a green-sensitised silver halide emulsion layer with a magenda coupler
5. a UV-absorber layer
6. a blue-sensitive silver halide emulsion layer with a yellow coupler and
7. a protective layer containing the sodium salt of ω-isonitritbutyric acid and formaldehyde. The materials thus prepared had a total gelatin content of 20 g per square metre and contained 0.66% of the sodium salt of isobutyronitrile and 0.45% of formaldehyde, based on the total gelatin content of the material.

The following materials were produced in accordance with this general procedure:

A. A colour photographic material with a blue-sensitive emulsion as described in (8) above, a green-sensitive emulsion as described in (3) above and a red-sensitive emulsion as described in (1) above.

B. For comparison, a colour photographic material was prepared in the same way as described in (A) above, except that emulsion No. 4 was used as the green-sensitive layer.

C. A photographic material was prepared as described in (A) execpt that emulsion No. 5 was used as the green-sensitive emulsion.

D. A photographic material was prepared in the same way as described in (A), except that emulsion No. 6 was used as the green-sensitive emulsion.

E. A photographic material was prepared in the same way as described in (A) above, except that emulsion No. 7 was used as the green-sensitive layer.

The photographic material (A) and (D) was a conventional material which was compared with materials (B), (C) and (E) according to the invention. The photographic materials (A) to (E) were then divided into two parts, and a sample of each stored for a few hours at room temperature/80% air humidity. The samples were then wrapped in an aluminium-lined bag, and stored in a conditioning cabinet for 3 days at 60° C/saturated air humidity.

The untreated samples of the photographic materials (A) to (E) were exposed directly behind a step wedge covered with a green filter, developed and bleach-fixed in the usual way. N-Butyl-N-δ-sulphobutyl-p-phenylene diamine was used as the colour developer, the processing temperature was 35° C and the development time 2 minutes.

The samples which had been stored in the conditioning cabinet were similarly exposed and developed.

Sensitometric evaluation of the samples thus obtained is presented in the following Table in which the reduction in colour density of the magenda dye of the samples which had been stored in a conditioning cabinet, in comparison with that of untreated samples is expressed in %.

TABLE

| Photographic Material | Reduction in colour density of the magenta dye in % |
|---|---|
| A | 75 |
| B | 46 |
| C | 52 |
| D | 71 |
| E | 35 |

As shown in the Table, the reduction in density of the purple dye in comparison materials (A) and (D) was much greater than in material (B) , (C) and (E) according to the invention which contained the magenta dye incorporated into the layers by means of oil formers (1) and (3) according to the invention. Similar results were obtained with colour materials which had been prepared in the same way as colour material (B) or (C), except that the magenta coupler had been emulsified into them by means of oil former (2) or (4) according to the invention. The reduction in density observed in that case amounted to 48% in the case of oil former No. 2) and to 54% in the case of oil former No. 4).

EXAMPLE 2

This Example shows that the oil formers according to the invention are still able to exert their favourable protective effect upon the magenta components when they are not used in the green-sensitive silver halide emulsion layer itself, but are present in an adjacent layer. The following materials were prepared in accordance with the general procedure described in Example 1:

F. A photographic material was prepared with emulsion No. (8) as the blue-sensitive layer, emulsion No. (3) as the green-sensitive layer and emulsion No. (2) as the red-sensitive layer.

The photographic material was divided into two samples as described in (1) above, and one sample stored in a conditioning cabinet as described in Example 1. Exposure and processing was carried out in the same way as in Example 1. The reduction in colour density of the purple dye amounted to only 62 %, whilst the reduction in colour density of the similar colour material (A) described in Example 1 amounted to 75 %.

EXAMPLE 3

A test similar to that described in Example 2 was carried out with the oil former according to the invention present in the blue-sensitive emulsion layer.

G. A colour photographic material was prepared with emulsion No. (9) as the blue-sensitive layer, emulsion No. (6) as the green-sensitive layer and emulsion No. (1) as the red-sensitive layer.

The colour photographic material thus prepared was divided into two samples, one of which was directly exposed and processed and another exposed and processed after storage in a conditioning cabinet, in the same way as described in Example 1. Comparison of the reduction in colour density of the magenta dye of material (C) according to the invention with the comparison material (D) shows that the reduction in density in the material according to the invention only amounted to 60%, whilst the comparison material was found to have undergone a reduction in density of 71%.

EXAMPLE 4

Materials were prepared in th same way as described in Examples 1 to 3, except that the protective layer contained the formaldehyde and the adhesion layer the sodium salt of isobutyronitrile.

The results obtained in this way were substantially similar to those obtained in Examples 1 to 3.

EXAMPLE 5

A further improvement by comparison with the photographic material described in Examples 1 to 4 could be obtained by emulsifying the UV absorber into the UV-absorber layer with the oil formers according to the invention.

The following emulsion for example can be used as the UV-absorber layer:

40 g of the following UV-absorber

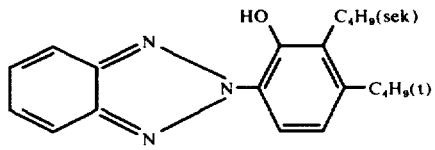

were dissolved together with 40 g of sulpho succinic acid-bis-(2-ethyl)-hexyl ester and 40 g of compound No. 1 according to the invention in 140 ml of ethyl acetate, and the resulting solution emulsified at 50° into 1 kg of a 10% gelatin solution. The solvent was subsequently removed in a thin-layer evaporator.

EXAMPLE 7

Photographic materials were prepared in the same way as described in Examples 1 to 6 and divided into two samples. Each sample was subjected as in Example 1 to treatment in a conditioning cabinet, and the untreated and treated samples exposed behind a grey step wedge and then processed as described in Example 1. Visual comparison showed that the samples according to the invention which had been subjected to treatment in a conditioning cabinet were much less greenish in colour than the prior art samples which was attributable to the far less serious reduction in colour density of the magenta dye. The untreated and treated materials which contained the emulsifiers according to the invention were distinguished by their high colour density, their high sharpness and their high stability in storage. Accordingly, the oil formers according to the invention are comparable in their photographic properties with the best of the conventional oil formers. In addition, they considerably increase the stability of the magenta colour couplers, as described in the preceding Examples, even when they have not been directly used in the silver halide emulsion layer. There was no sign of any reduction in colour density attributable to co-coupling of the oil former according to the invention.

Similar results can be obtained by developing the photographic materials with a less hydrophilic developer. Such as for instance N,N-diethyl-3-methyl-p-phenylene diamine or N-ethyl-N$\beta$-hydroxyethyl-3-methyl-p-phenylene diamine.

We claim:

1. A process for the production of photographic layers containing emulsified substances in heterogeneous distribution comprising the step of emulsifying the substances in solubilized form into a hydrophilic phase in the presence of an oilformer compound and applying the emulsion formed to a substrate, the emulsified substances are selected from the group consisting of couplers, UV-absorbers, white toners or stabilizers (to dissolve said substances, wherein the improvement comprises providing a substantially diffusion-resistant, substantially water-insoluble, substantially non-coupling oilformer compound which is of the formula $$R_1 - CO - CH_2 - R_2$$

wherein $R_2$ represents a cyano group or the group $COR_3$, $R_1$ and $R_3$ represents alike or different groups selected of linear or branched chain alkyl with up to 20 carbon atoms, cyclohexyl and cyclopentyl groups, aryl groups, aralkyl groups, alkoxy groups, aroxy groups and aralkoxy groups; the total number of carbon atoms in $R_1$ and $R_3$ amounting to at least 6, if $R_1$ an $R_3$ both are alkyl or together complete an alkyl substituted or aryl substituted or annelated heterocyclic, heteroaromatic or aromatic ring and the total number of carbon atoms in $R_1$ and $R_3$ amounting to at least 10, if $R_1$ represents alkoxy and $R_3$ represents alkoxy or aralkoxy, which oilformer compound is capable of stabilizing the photographic layers against the damaging influence of aldehyde-containing or releasing hardening agents.

2. A process of claim 1 wherein the oilformer is used in addition to low boiling or high boiling solvents.

3. The process as claimed in claim 1 wherein a pyrazolone magenta-, an open-chained ketomethylene yellow- a $\alpha$-naphtholic- or phenolic cyan coupler is emulsified.

4. The process as claimed in claim 1 wherein a 3-acylamino- or a 3-anilinopyrazolone-5-coupler is emulsified.

5. The process as claimed in claim 1 wherein the oilformer is present in an amount of at least 50% of the solvent for solubilizing the substances.

6. A photographic silver halide material containing at least one emulsified substance selected from the group consisting of couplers, UV-absorber, white toners and stabilizers, the emulsified substance being present in at least one hydrophilic layer of the silver halide material and is emulsified in an oilformer compound, wherein the improvement comprises the oilformer is a substantially diffusion-resistant, substantially water-insoluble, substantially non-coupling, dispersible compound of the formula $$R_1 - CO - CH_2 - R_2$$

wherein $R_2$ represents a cyano group or the group $COR_3$, $R_1$ and $R_3$ represents alike or different groups selected of linear or branched chain alkyl with up to 20 carbon atoms, cyclohexyl and cyclopentyl groups, aryl groups, aralkyl groups, alkoxy groups, aroxy groups and aralkoxy groups; the total number of carbon atoms in $R_1$ and $R_3$ amounting to at least 6, if $R_1$ and $R_3$ both are alkyl or together complete an alkyl substituted or aryl substituted or annelated heterocyclic, heteroaromatic or aromatic ring and the total number of carbon atoms in $R_1$ and $R_3$ amounting to at least 10, if $R_1$ represents alkoxy and $R_3$ represents alkoxy or aralkoxy, and the emulsified substance is present in a stable dispersion a photographic layer in effective contact with a silver halide emulsion layer which contains as coupler a 3-anilino- or a 3-acylamino pyrazolone-5- coupler.

7. The material of claim 6, wherein the photographic layer is a lightsensitive silver halide emulsion layer which contains the coupler as emulsified substance.

8. A photographic silver halide material containing at least one emulsified substance selected from the group consisting of couplers, UV-absorber, white toners and stabilizers, the emulsified substance being present in at least one hydrophilic layer of the silver halide material and is emulsified in an oilformer compound, the improvement according to which the oilformer is a substantially diffusion-resistant, substantially water-insoluble, substantially non-coupling, dispersible compound of the formula $$R_1 - CO - CH_2 - R_2$$

wherein $R_2$ represents a cyano group or the group $COR_3$, $R_1$ and $R_3$ represents alike or different groups selected of linear or branched chain alkyl with up to 20 carbon atoms, cyclohexyl and cyclopentyl groups, aryl groups, aralkyl groups, alkoxy groups aroxy groups and aralkoxy groups; the total number of carbon atoms in $R_1$ and $R_3$ amounting to at least 6, if $R_1$ and $R_3$ both are alkyl or together complete an alkyl substituted or aryl substituted or annelated heterocyclic, heteroaromatic or aromatic ring and the total number of carbon atoms in $R_1$ and $R_3$ amounting to at least 10, if $R_1$ represents alkoxy and $R_3$ represents alkoxy or aralkoxy, and at least one of the emulsified substances is a pyrazolone-5coupler.

* * * * *